US010851516B2

(12) United States Patent
Hensel et al.

(10) Patent No.: US 10,851,516 B2
(45) Date of Patent: Dec. 1, 2020

(54) SHAFT COVER FOR SHAFTS, CHANNEL ENTRANCES, OR DRAINAGE CHANNELS

(71) Applicant: BASF SE, Ludwigshafen am Rhein (DE)

(72) Inventors: Torsten Hensel, Ludwigshafen (DE); Patrick Frey, Ludwigshafen (DE); Helge Weiler-Schlecker, Ludwigshafen (DE); Andreas Wuest, Ludwigshafen (DE); Kay Michael Brockmueller, Ludwigshafen (DE); Milan Kopecek, Prague (CZ); Andre Schaefer, Ludwigshafen (DE); Joaquin Perez, Sant Pere de Ribes (ES)

(73) Assignee: BASF SE

( * ) Notice: Subject to any disclaimer, the term of this patent is extended or adjusted under 35 U.S.C. 154(b) by 0 days.

(21) Appl. No.: 16/311,386

(22) PCT Filed: Jun. 19, 2017

(86) PCT No.: PCT/EP2017/064927

§ 371 (c)(1),
(2) Date: Dec. 19, 2018

(87) PCT Pub. No.: WO2017/220487

PCT Pub. Date: Dec. 28, 2017

(65) Prior Publication Data

US 2019/0323199 A1 Oct. 24, 2019

(30) Foreign Application Priority Data

Jun. 20, 2016 (EP) ..... 16175328

(51) Int. Cl.
*E02D 29/00* (2006.01)
*E02D 29/14* (2006.01)

(52) U.S. Cl.
CPC ..... *E02D 29/14* (2013.01)

(58) Field of Classification Search
CPC ..... E02D 29/14
(Continued)

(56) References Cited

U.S. PATENT DOCUMENTS 7,484,909 B2 * 2/2009 Brady ..... E02D 29/124 404/25
7,914,227 B2 * 3/2011 Jordan ..... E02D 29/14 404/25

(Continued)

FOREIGN PATENT DOCUMENTS

CN 101089300 A 12/2007
CN 201068571 Y 6/2008

(Continued)

OTHER PUBLICATIONS

English Translation of International Preliminary Report on Patentability for International Patent Application No. PCT/EP2017/064927, dated Dec. 20, 2018, 6 pages.

(Continued)

*Primary Examiner* — Raymond W Addie
(74) *Attorney, Agent, or Firm* — Armstrong Teasdale LLP

(57) ABSTRACT

A manhole cover for manholes, sewer accesses or drainage channels, including a reinforcing element and a body made of plastic which is connected to the reinforcing element. The reinforcing element may be constructed from intersecting, vertically aligned elements. Corrugations may be formed in the reinforcing element. The reinforcing elements may be arched and may include an outer encircling strip and a central plate, which are each connected to the body made of plastic. The reinforcing element rests on a bearing surface on the manhole, sewer access or drainage channel when the manhole, sewer access or drainage channel is closed by (Continued)

means of the manhole cover. The body made of plastic includes ribs, which extend perpendicularly or at an angle of more than 45° to the surface surrounding the manhole cover, sewer access or drainage channel when the manhole, sewer or drainage channel is closed.

9 Claims, 7 Drawing Sheets

(58) Field of Classification Search
USPC ..... 404/25, 26; 52/19
See application file for complete search history.

(56) References Cited

U.S. PATENT DOCUMENTS

2008/0075532 A1 3/2008 Boyd
2010/0329782 A1* 12/2010 Miller ..... E02D 29/14 404/25
2012/0114414 A1* 5/2012 Jang ..... E02D 29/14 404/25
2013/0011194 A1* 1/2013 Lorenz ..... E02D 29/14 404/25
2018/0216352 A1 8/2018 Henisek et al.
2019/0048962 A1 2/2019 Wuest et al.

FOREIGN PATENT DOCUMENTS

CN 201148624 Y 11/2008
CN 203145657 U 8/2013
CN 204059412 U 12/2014
GB 1561499 A 2/1980
GB 2308148 A 6/1997

OTHER PUBLICATIONS

International Search Report for International Application No. PCT/EP2017/064927, dated Aug. 10, 2017, 2 pages.

* cited by examiner

FIG.11.1
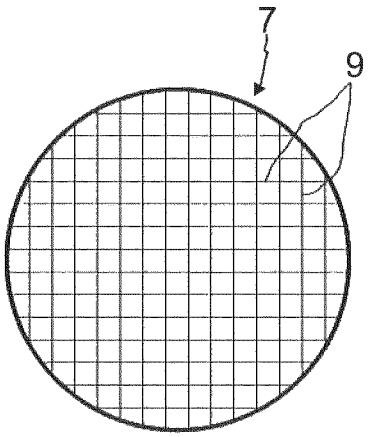
FIG.11.2
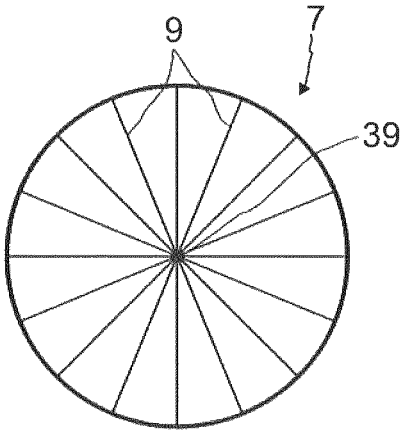
FIG.11.3
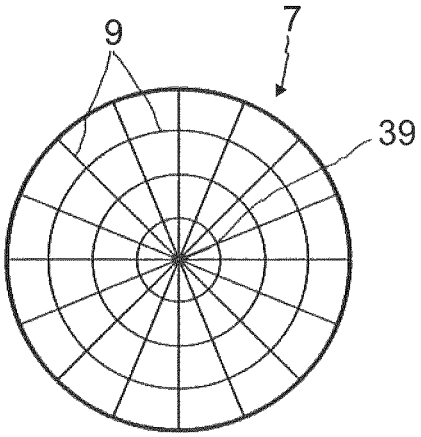
FIG.11.4
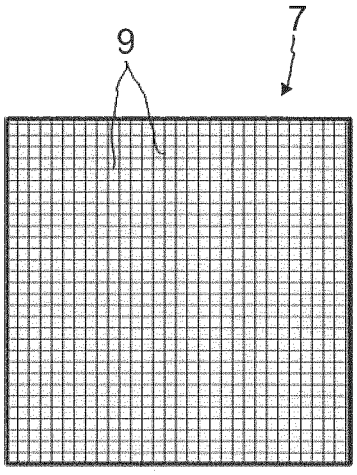

SHAFT COVER FOR SHAFTS, CHANNEL ENTRANCES, OR DRAINAGE CHANNELS

CROSS-REFERENCE TO RELATED APPLICATIONS

This application is a U.S. National Phase Application of PCT/EP2017/064927, filed Jun. 19, 2017, which claims the benefit of priority to EP Application No. 16175328.0, filed Jun. 20, 2016, the contents of which are hereby expressly incorporated by reference in their entirety.

The invention relates to a manhole cover for manholes, sewer accesses or drainage channels in traffic-carrying surfaces.

Particularly when used in road surfaces, the manhole covers must be able to support the load imposed by heavy vehicles, e.g. heavy goods vehicles. If use is envisaged on sidewalks or pedestrianized areas or in drives, for example, relatively low load classes are generally also sufficient since there is generally no heavyweight traffic here.

Currently, corresponding manhole covers are manufactured from cast iron, for example, wherein a concrete inset can be introduced into the manhole cover to form the surface of the manhole cover. The concrete inset can be machined in order in this way to obtain a smooth surface, for example.

However, the disadvantage of the corresponding manhole covers is the very high weight thereof, and this is disadvantageous especially when the manhole, sewer access or drainage channel is to be opened for maintenance purposes, for example. Opening requires great physical effort, which can damage the health of the workers employed. It is therefore desirable to manufacture manhole covers with a lower mass.

For manhole covers with lower requirements on load bearing capacity, e.g. for use on paths, in private drives or even on terraces, the use of a plastic to minimize the mass of the manhole cover is already known. However, these cannot be used for higher load classes, in particular not for load class D400, owing to their construction.

It was therefore the object of the present invention to provide a manhole cover for manholes, sewer accesses or drainage channels, especially for high load classes, which has a lower weight than the previously known manhole covers.

This object is achieved by a manhole cover for manholes, sewer accesses or drainage channels, comprising a reinforcing element and a body made of plastic, which is connected to the reinforcing element, wherein the reinforcing element is designed in such a way that said reinforcing element rests on a bearing surface on the manhole, sewer access or drainage channel when the manhole, sewer access or drainage channel is closed by means of the manhole cover, and the body made of plastic comprises ribs, which extend perpendicularly or at an angle of more than 45° to the surface surrounding the manhole, sewer access or drainage channel when the manhole, sewer access or drainage channel is closed.

Surprisingly, it has been found that the use of a reinforcing element and a manhole cover construction involving a body made of plastic makes it possible to obtain a manhole cover which satisfies even the requirements of high load classes, e.g. those corresponding to class D400 according to DIN EN 124-1:2015-09 or DIN EN 1433:2005-05 or DIN 19580:2010-07 or higher, and has a significantly lower weight than the manhole covers currently in common use, which consist of cast iron or of a composite of cast iron and concrete. Of course, a manhole cover of this kind also complies with lower load classes, e.g. A15, B125, C250 according to DIN EN 124-1:2015-09 or DIN EN 1433:2005-05 or DIN 19580:2010-07.

In the context of the present invention, both drains and accesses to gas pipes, water pipes or power and telecommunication lines, for example, and to equipment used in such pipes or lines are referred to as manholes.

Sufficient static strength and dimensional stability are achieved if the body made of plastic is constructed from elements that are connected materially to one another and have a substantially equal wall thickness. Here, "substantially equal wall thickness" means that the wall thickness of the individual elements differs by no more than 50% from each other. The individual elements of the body made of plastic are base plates and/or ribs, for example. In this case, the base plate extends parallel to the surface surrounding the manhole, sewer access or drainage channel when the manhole cover is installed. In this case, the body can be constructed either with or without a base plate. It is possible for the body made of plastic to be constructed only of ribs extending perpendicularly to the surface surrounding the manhole, sewer access or drainage channel. According to the invention, the ribs are either perpendicular to the surface surrounding the manhole, sewer access or drainage channel or at an angle of more than 45° to the surface surrounding the manhole, sewer access or drainage channel. The ribs are preferably aligned at an angle of between 80° and 90° to the surface surrounding the manhole, sewer access or drainage channel, wherein an angle of 90° means that the ribs extend perpendicularly to the surface.

In order to obtain uniform load distribution in the body made of plastic, the ribs extend in at least two directions, ensuring that the ribs intersect at at least one point of intersection. In this case, the ribs can form a grid, for example, or can also converge on a central point in a star shape. In the case of a star-shaped arrangement of ribs, it is furthermore possible also to provide ribs which surround the central point in a ring shape, wherein a rib segment of the rib surrounding the central point in a ring shape lies in each case between two of the ribs arranged in a star shape. The rib segment can in each case extend in a straight line or along a curve. It is preferred, however, when the ribs form a grid, which means a structure of crossing ribs.

The outer circumference of the manhole cover can have any desired shape, wherein the shape corresponds to shape of the cross section of the manhole, sewer access or drainage channel to be covered. Conventional shapes of the outer circumference of the manhole cover are a circular shape, a rectangular shape or an oval shape.

In a first embodiment of the invention, the reinforcing element is arched. In this case, the reinforcing element can either be arched downward, i.e. concavely, or arched upward, i.e. convexly, in a plan view of the installed manhole cover. In the case of a downward-arched reinforcing element, the lowest point of the reinforcing element is thus situated in the central area of the manhole cover when the manhole cover is installed, whereas, in the case of an upward-arched reinforcing element, the highest point of the reinforcing element is situated in the central area of the manhole cover. The highest point in the case of an upward-arched reinforcing element and the lowest point in the case of a downward-arched reinforcing element are preferably situated in the center of the manhole cover.

The reinforcing element is preferably arched upward. However, this is not possible particularly if the bearing surface on which the manhole cover rests after installation has only a slight depth. In order to allow installation flush with the surface, the manhole cover in this case must have only a slight thickness at the edge. The maximum thickness of the manhole cover is in the center of the manhole cover. To obtain a level surface, a downward curvature which projects into the manhole, sewer access or drainage channel is necessary here.

In contrast, a manhole cover having a reinforcing element which is arched upward has the maximum thickness at the edge and the minimum thickness in the center of the manhole cover. This requires a correspondingly deep bearing surface for installation in order to allow installation flush with the surface.

Irrespective of whether the reinforcing element is arched upward or downward, it is preferred if the body made of plastic rests on the reinforcing element, with the result that the reinforcing element is at the bottom when the manhole cover is installed and it is thus possible for the reinforcing element and not plastic material to rest on the bearing surface when the manhole cover is installed. In particular, this has the advantage that, when there is a heavy load on the manhole cover, there is no damage to the bearing surface of the manhole cover, e.g. cracks or flaking of the body made of plastic material.

In one embodiment of the invention, the upward- or downward-arched reinforcing element is formed without openings or holes. In an alternative embodiment, openings or holes are formed in the reinforcing element of arched design, it being possible for said openings or holes to be used for ventilation of the manhole, sewer access or drainage channel, for example. Moreover, appropriate holes in the reinforcing element also make it possible for water to drain from the surface into the manhole, sewer access or drainage channel. It is a requirement both for the ventilation function and for the water drainage function that the body made of plastic has openings through which air and/or water can flow, particularly at the positions at which the openings or holes in the reinforcing element are formed.

In one embodiment of the invention, the upward- or downward-arched reinforcing element is not embodied in the form of a plate but is constructed from arched strips which converge in the center of the reinforcing element. In this case, the strips are arched in such a way that, depending on the installation of the reinforcing element, either the highest point of the reinforcing element or the lowest point of the reinforcing element is in the center of the manhole cover. In this case, the strips have a parabolic, a hyperbolic or an elliptical profile, or have the shape of a circular arc from the outside toward the center of the manhole cover. Irrespective of the shape of the curvature of the individual strips, however, it is preferred if the arched profile is constant from edge to edge of the manhole cover across the center.

If the reinforcing element is constructed from strips, it is preferred, in particular, if the strips extend in a star shape from the center of the reinforcing element to the edge. In this case, the ends of the strips can be connected by an outer encircling strip. Here, the shape of the outer encircling strip is dependent on the shape of the manhole cover. The shape of the outer encircling strip preferably corresponds to the shape of the manhole cover, with the result that, in the case of a round manhole cover, the encircling strip is likewise round whereas, in the case of an angular manhole cover, the outer encircling strip is likewise angular.

In another embodiment, the reinforcing element comprises an outer encircling strip and a central plate, which are each connected to the body made of plastic, wherein the central plate or a rod connected to the central plate and extending in an axial direction is connected to the outer encircling strip by spokes, rods or cables. In the manhole cover, the body made of plastic can surround the spokes, rods or cables or rest on the spokes, rods or cables.

If the body made of plastic surrounds the spokes, rods or cables, the reinforcing element is preferably overmolded during the production of the manhole cover. In an embodiment in which the body made of plastic rests on the spokes, rods or cables, it is possible to produce the reinforcing element and body made of plastic in two independent production steps and then to join them together and connect them, for example by screwing, clipping, welding, adhesive bonding or riveting.

In another embodiment, it is also possible to configure the reinforcing element in such a way that corrugations are formed in the reinforcing element. In this case, it is possible either to use a flat plate as a reinforcing element and to form the corrugations in the flat plate or, as an alternative, to embody the reinforcing element in an arched manner as described above and to introduce corrugations in addition. In this case, the corrugations are preferably arranged in such a way that there are in each case strips between the corrugations, said strips extending from the center of the reinforcing element toward the edge. This leads to a substantially triangular shape of the corrugations, where the width of the corrugations decreases from the outside toward the center of the reinforcing element. As a result, the strips between the corrugations are arranged in a substantially star-shaped pattern. As an alternative to introducing corrugations, it is also possible to make the reinforcing element corrugated, for example, with the corrugations being embodied in such a way that they converge centrally on a central point of the reinforcing element.

The reinforcing element embodied with corrugations or the corrugated reinforcing element can also additionally have openings or holes to allow ventilation of the manhole, sewer access or drainage channel or to provide the possibility of enabling water to drain from the manhole cover into the manhole, sewer access or drainage channel.

If the reinforcing element is embodied with an encircling strip, it is possible to provide openings or holes in the encircling strip to allow ventilation or water drainage. As an alternative, however, it is also possible to use the open areas between the arched strips or between the spokes, rods or cables for ventilation or water drainage.

In another embodiment, it is also possible to construct the reinforcing element from intersecting vertical elements. In this case, the vertical elements are preferably flat on the side facing the surface of the road when the manhole cover is inserted and can be curved on the opposite side, i.e. the side facing into the manhole, sewer access or drainage channel. In order to connect the vertical elements to one another, it is possible, for example, to make slots in said elements and thus insert the individual intersecting, vertically extending elements into one another. As an alternative, it is of course also possible to weld the individual elements to one another. However, inserting the elements into one another is preferred. In an embodiment of this kind with vertical elements of the reinforcing element, these are surrounded by the body made of plastic to produce the manhole cover. For this purpose, it is particularly preferred to insert the reinforcing element into an injection molding machine and to overmold the reinforcing element to produce the body made of plastic. In order to obtain a level surface, it is furthermore advantageous to provide a plate for covering, wherein said plate preferably likewise has vertically extending ribs and optionally a base plate, wherein the covering plate rests by means of the ribs on the reinforcing element if no base plate is provided or by means of the base plate if a base plate is provided. Here, the spacing of the ribs by means of which the plate for covering rests on the reinforcing element is smaller than the spacing between the individual elements from which the reinforcing element is produced. Better distribution over the reinforcing element is thereby achieved.

Suitable materials for the reinforcing element are, for example, metals, ceramics or reinforced plastics, wherein, if a reinforced plastic is used, a plastic reinforced with continuous fibers is preferably used. Especially if the reinforcing element is arched downward or consists of an encircling strip and a central plate which are connected by rods, spokes or cables, the reinforcing element is composed of a metal or of a plastic reinforced with continuous fibers, in particular of a metal since the reinforcing element is subjected especially to tensile stress in this case and therefore a material resistant to tensile stresses has to be used. In contrast, the reinforcing element in an upward-arched embodiment is subjected to compression and therefore, in this case, materials which are resistant to compressive stresses should be used, with metals also being preferred as materials for the reinforcing element in this case.

Ferrous metals, e.g. cast iron or steel, are particularly preferred as materials for the reinforcing element. The advantage of using steel is the greater plastic deformability thereof. This has the advantage that a reinforcing element made of steel can be made thinner and hence with a lower mass than a reinforcing element made of cast iron. Another advantage in using steel for the reinforcing element is that the reinforcing element can be formed by means of conventional processing methods suitable for steel. Thus, for example, it is possible to punch the shape of the reinforcing element out of a steel plate and to form it by deep drawing.

Thus, for example, a reinforcing element having an encircling rim and a central plate, wherein the encircling rim and the central plate are connected to one another by strips, can be produced by punching or cutting an inner part comprising the central plate, on which strips extending in a radial direction are formed, out of a circular plate. This gives rise to a second part, which has the outer rim with strips extending toward the central point. The strips which are connected to the outer rim are preferably exactly the same width as the strips which project outward from the central plate. To produce the reinforcing element, both the part having the outer rim and inward-projecting strips and the part having the central plate and the outward-projecting strips can then be given the arched shape desired for the reinforcing element, and the inward-projecting strips and the outward-projecting strips can then be connected to one another, by welding for example, in order to obtain a reinforcing element. Apart from welding the inward- and outward-projecting strips, any other connection between metallic components, e.g. riveting, screwing, adhesive bonding or hooking into one another, is of course also possible. However, hooking the strips into one another is preferred.

Any desired thermosetting plastic or thermoplastic can be used as a material for the body made of plastic. A thermoplastic is preferably used since it is easier to injection mold and recycle. Examples of suitable thermoplastics are polyesters, such as polyethylene terephthalate (PET), polybutylene terephthalate (PBT); polyamide (PA); polyvinylchloride (PVC), polypropylene (PP), polyethylene (PE), polystyrene (PS), polycarbonate (PC), styrene-acrylonitrile copolymer (SAN), acrylonitrile-butadiene-styrene copolymer (ABS), acrylonitrile-styrene-acrylic ester (ASA), polyoxymethylene (POM), polymethylmethacrylate (PMMA), polystyrene (PS), syndiotactic polystyrene (SPS), polyphthalamide (PPA), polyphenylene sulfide (PPS). Preferred examples of these are polyamide (PA), polyvinylchloride (PVC), polypropylene (PP), polyethylene (PE) and polycarbonate (PC). Polyamide 6 or polyamide 6.6 are particularly preferred as plastics.

If a thermosetting plastic is used as a material for the body made of plastic, the following are suitable, for example: formaldehyde molding compounds, e.g. phenol-formaldehyde resin (PF), resorcinol-formaldehyde resin (RF), cresol-formaldehyde resin (CF), xylol-formaldehyde resin (XF), furfuryl alcohol-formaldehyde resin (FF), melamine-formaldehyde resin (MF), ureaformaldehyde resin (UF), melamine-urea-formaldehyde resin (MUF), melamine-urea-phenolformaldehyde resin (MUPF), unsaturated polyester resins (UP), vinyl ester resins (VE), phenacrylate resins, vinyl ester urethanes (VU), epoxy resins (EP), diallyl phthalate resins, allyl esters (PDAP), silicone resins (SI), polyurethanes (PUR).

To modify the properties of the plastic, the plastic can contain at least one filler for reinforcement. The filler for reinforcement can be in the form of fibers or particles. Examples that can be used are carbon fibers, glass fibers, glass balls, amorphous silica, asbestos, calcium silicate, calcium meta-silicate, magnesium carbonate, kaolin, chalk, powdered quartz, mica, barium sulfate and feldspar.

To achieve adequate reinforcement, in particular adequate tensile or compressive strength, the filler for reinforcement should preferably be in the form of fibers.

Preferred fillers in the form of fibers are glass fibers, carbon fibers, aramid fibers and potassium titanate fibers. Among these, glass fibers are particularly preferred. The fillers in the form of fibers can be used as rovings, mats or as chopped glass in the commercially available forms.

As a particularly preferred option, the fibers are used as short staple fibers or long staple fibers and generally have a length in a range of from 0.1 to 14 mm. The diameter of the fibers is preferably in a range of from 5 to 20 μm.

To improve adhesion to the thermoplastics, the surface of the fillers can be pretreated.

Here, the proportion of fillers in the plastic is preferably in a range of from 10 to 70% by weight, in particular in a range of from 40 to 65% by weight, based on the total mass of the plastic, including all the additives.

The plastic can furthermore contain conventional additives. Examples of conventional additives are impact modifiers, plasticizers, UV stabilizers, pigments, stabilizers and mold release agents. Any desired additives known to a person skilled in the art can be used in this context. The additives are added in amounts conventional in the art.

Irrespective of whether the body made of plastic has a base plate in addition to the ribs, the body made of plastic in one embodiment of the invention is configured in such a way that it has a flat plate which rests on the ribs and is connected to the ribs. By means of the plate resting on the ribs, it is possible to obtain a manhole cover surface which is preferably structured to avoid accidents due to a smooth surface. Such accidents can occur particularly when the surface is moist or wet and a pedestrian or vehicle slips on it. As an alternative, it is also possible to introduce a pattern or a pictorial image into the plate. Corresponding pictorial images can be of a purely artistic nature to upgrade the manhole cover visually. As an alternative, however, it is also possible to introduce company logos or advertising in the form of a relief into the surface of the plate, for example. However, a smooth surface is preferred.

As an alternative to the formation of the plate from plastic, it is also possible to provide an upper plate made from the same material as the reinforcing element. In this case, the material of the reinforcing element surrounds the body made of plastic. Moreover, the upper plate acts as an additional reinforcement. After the insertion of the body made of plastic, the reinforcing element and the upper plate are connected to one another, wherein a material, positive or nonpositive connection is possible here. Suitable techniques for connecting the reinforcing element and the upper plate are welding or screwing, in particular. A releasable connection is preferred here to enable individual components of the manhole cover to be replaced if required. If the reinforcing element and the upper plate are screwed together, it is also possible to use a screwed joint for this purpose, by means of which the manhole cover is screwed to the bearing surface of the manhole, sewer access or drainage channel.

Irrespective of the shape of the reinforcing element, the body made of plastic can be connected positively or nonpositively to the reinforcing element. A positive connection is obtained, for example, if the body made of plastic is produced by an injection molding method and the reinforcing element is placed in the mold before the injection of the plastic, thus enabling the reinforcing element to be overmolded with the plastic.

Owing to the differential thermal expansion of the reinforcing element and the plastic material, however, the preference is to connect the body made of plastic nonpositively or positively to the reinforcing element at selected positions and thus to permit a relative motion between the body made of plastic and the reinforcing element between the fastening positions. However, care should be taken here to ensure that the body made of plastic rests slidably on the reinforcing element. The fact that the body made of plastic rests on it ensures that loads imposed on the body made of plastic, e.g. when a vehicle drives over the manhole cover, are transmitted uniformly to the reinforcing element.

In order to connect the body made of plastic to the reinforcing element, it is possible, for example, to form holes in the reinforcing element, through which holes the plastic of the body made of plastic is forced for connection to the reinforcing element, or to clip or screw the body made of plastic to the reinforcing element. If the plastic material is forced through holes in the reinforcing element, the plastic is forced through the holes in a molten state during the production of the body made of plastic. In order to obtain a stable connection, the quantity of plastic which is forced through the holes is sufficiently large to ensure that a head is formed at each hole underneath the reinforcing element, said head resting on the underside of the reinforcing element made of metal and having a larger diameter than the hole. As an alternative to the connection by injecting the plastic through holes in the reinforcing element, it is also possible to overmold the reinforcing element with the plastic, as already described above.

Another possibility for connecting the body made of plastic to the reinforcing element is screwing or clipping. If the body made of plastic is to be screwed to the reinforcing element, it is possible, for example, to provide through-holes both in the reinforcing element and in the body made of plastic, through which holes bolts fastened with nuts are passed. As an alternative, it is also possible for threads to be formed in the reinforcing element and through holes to be formed in the body made of plastic or for threads to be formed in the body made of plastic and through-holes to be formed in the reinforcing element and to pass screws through the through-holes and to screw them into the thread in the reinforcing element or in the body made of plastic. Another possibility for screw fastening is to form short threaded rods on the reinforcing element or on the body made of plastic, these being passed through through-holes in the respective other part and fixed with nuts. If the body made of plastic and the reinforcing element are to be clipped together, either clips can be attached to the components or separate clips are used.

Apart from through-injection, overmolding, screwing or clipping, any other possibility for connecting the body made of plastic and the reinforcing element is also possible, e.g. riveting or adhesive bonding.

It is furthermore also possible to implement an overmolding in which the body made of plastic surrounds the reinforcing element at the outer circumference.

However, connections which allow movement relative to one another are preferred in order to be able to compensate for thermal stresses in the case of differential thermal expansions.

To prevent the manhole cover from being easily removed from the manhole, sewer access or drainage channel owing to the low weight, it is furthermore preferred if countersunk holes are formed in the manhole cover, through which holes the manhole cover can be screwed to the bearing surface on the manhole, sewer access or drainage channel. In order to remove the manhole cover, it is necessary here first of all to loosen the screws by means of which the manhole cover is fastened.

Illustrative embodiments of the invention are shown in the figures and are explained in greater detail in the following description.

Figure 3:
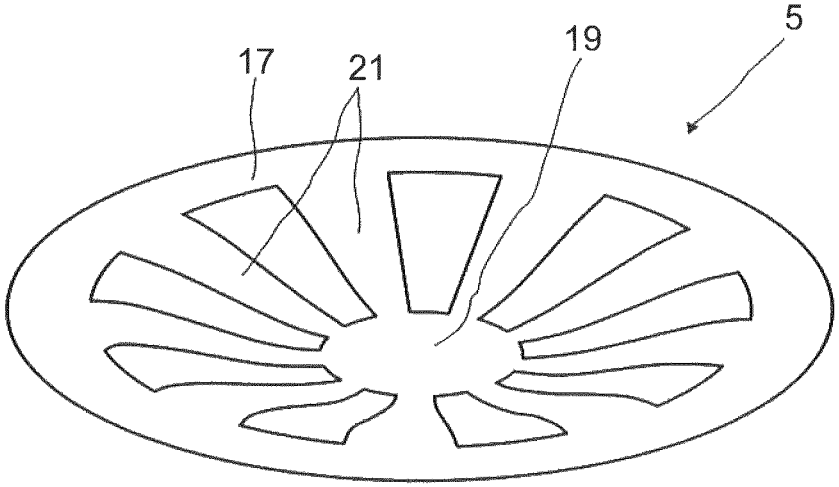
FIG. 3 shows a reinforcing element having a plurality of arched strips.
Figure 4:
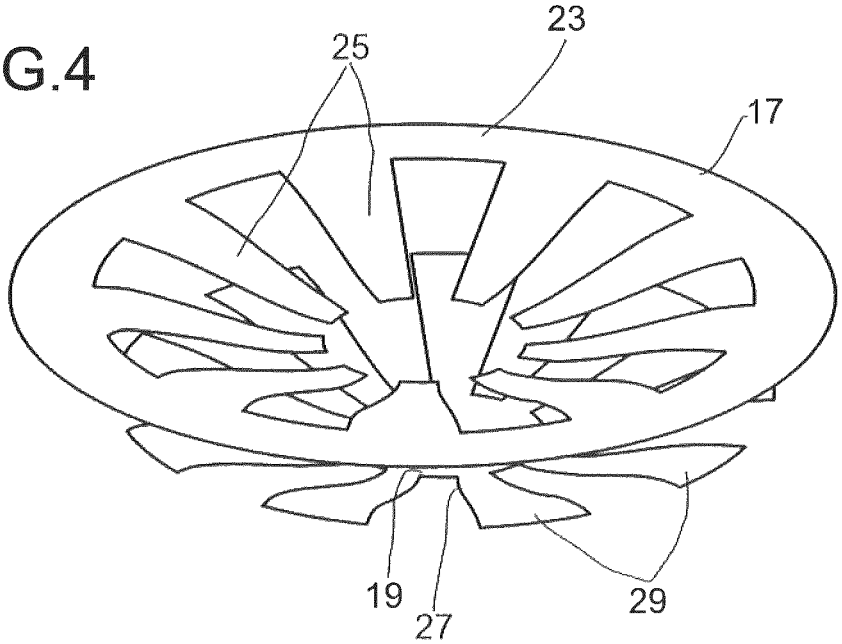
Figure 5:
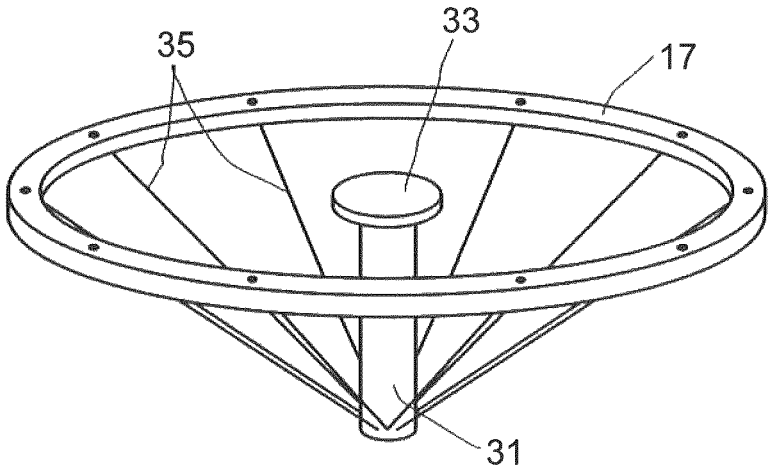
Figure 6:
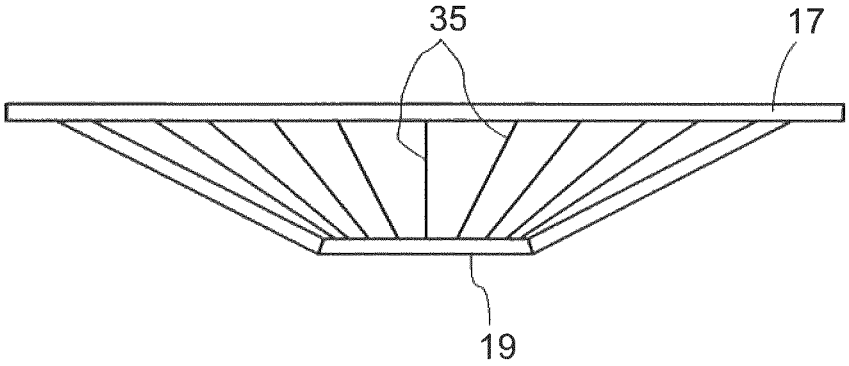
Figure 7:
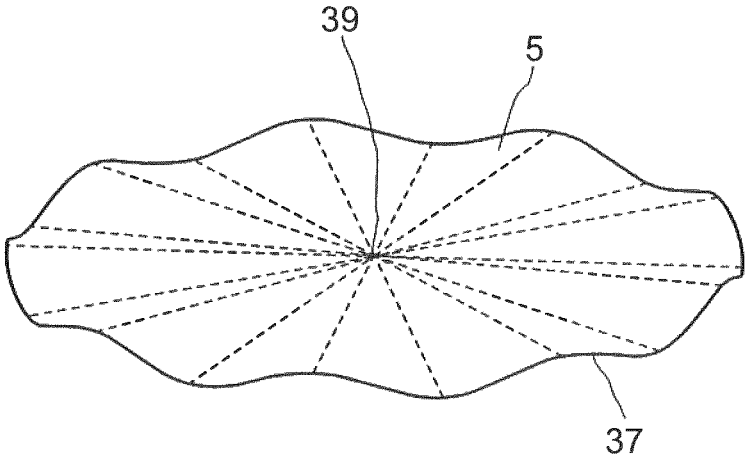
Figure 8:
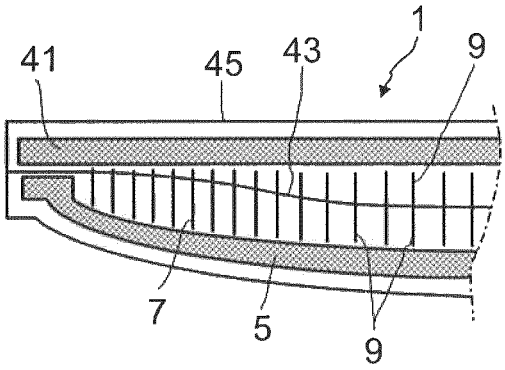
Figure 9:
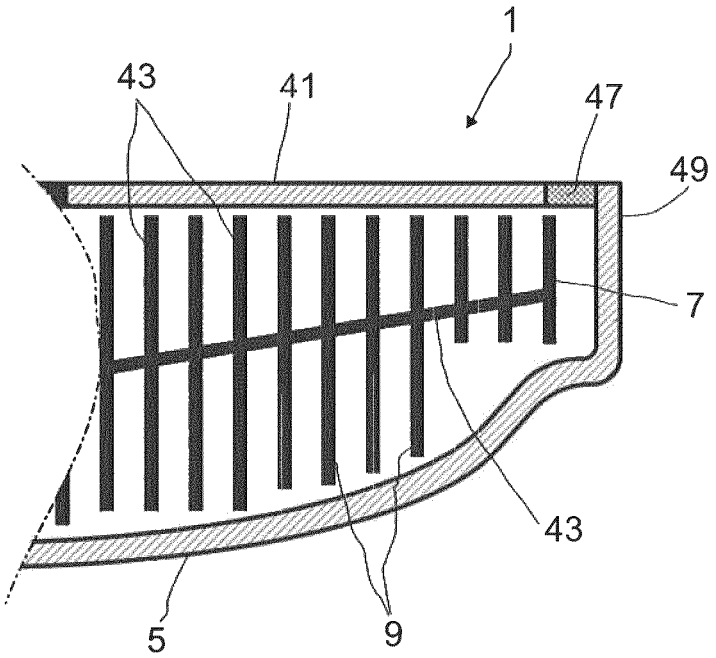
Figure 10:
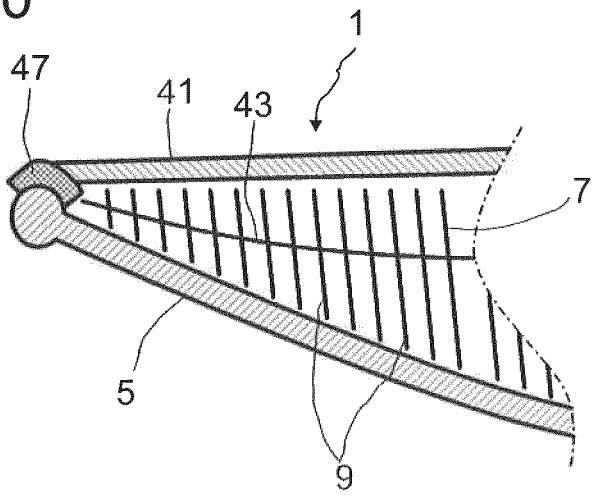
Figure 12:
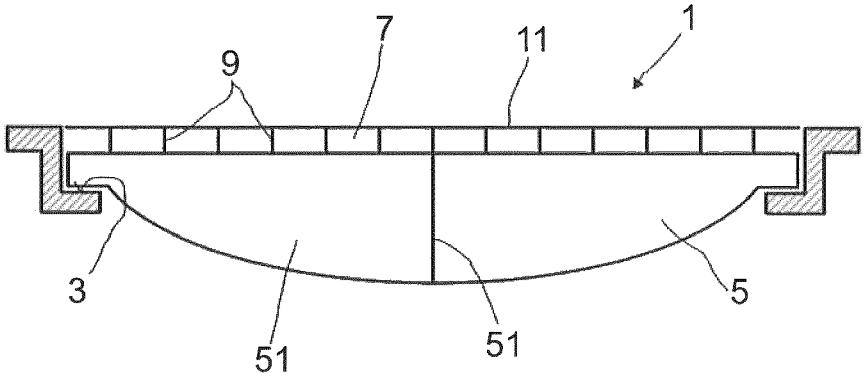

FIG. 4 shows two individual parts, which give the reinforcing element illustrated in FIG. 3 when joined together, FIG. 5 shows a reinforcing element having an encircling outer strip and a central rod, which is attached by spokes to the outer encircling strip, FIG. 6 shows a reinforcing element having an encircling outer strip and a central plate, which is attached by spokes to the outer encircling strip, FIG. 7 shows a reinforcing element having corrugations of corrugated design, FIG. 8 shows a detail of a manhole cover having a lower reinforcing element, an upper plate made from the same material as the reinforcing element, a body made of plastic between the metallic parts and an outer casing made of plastic, FIG. 9 shows a detail of a manhole cover having a reinforcing element, an upper plate and a body made of plastic situated between them in a first embodiment, FIG. 10 shows a detail of a manhole cover having a reinforcing element, an upper plate and a body made of plastic in a second embodiment, FIGS. 11.1 to 11.4 show various rib geometries for the body made of plastic, FIG. 12 shows a section through a manhole cover having vertically aligned elements to form the reinforcing element.

Figure 1:
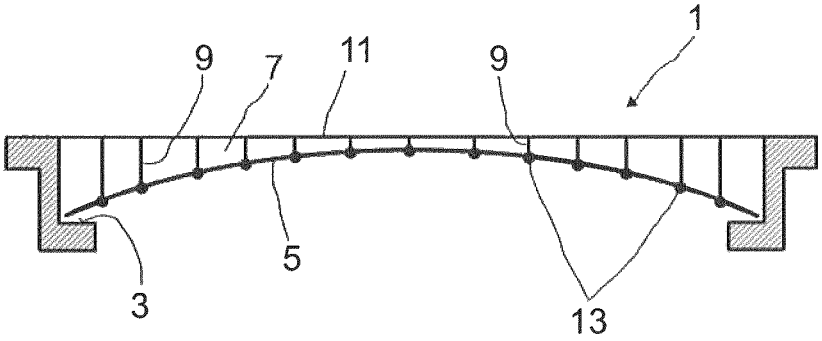
FIG. 1 shows a manhole cover having an upward-arched reinforcing element.

FIG. 1 shows a section through a manhole cover having an upward-arched reinforcing element.

A manhole, a sewer access or a drainage channel is covered with a manhole cover 1. For this purpose, the manhole, sewer access or drainage channel has a bearing surface 3. Here, the bearing surface 3 runs around the circumference of the manhole, sewer access or drainage channel.

According to the invention, the manhole cover has an reinforcing element 5 and a body 7 made of plastic. In the embodiment shown here, the body made of plastic has ribs 9 and a plate 11 resting on the ribs 9. Here, the plate 11 resting on the ribs 9 is generally connected materially to the ribs. By means of the plate 11 resting on top, a smooth surface of the manhole cover 1 can be obtained.

In order to connect the body made of plastic 7 to the reinforcing element 5, it is preferred if holes are formed in the reinforcing element 5, through which holes the plastic compound can flow. Enlarged portions 13 form under the holes in the reinforcing element 5, ensuring that a stable connection between the reinforcing element 5 and the body 7 made of plastic is obtained. A corresponding fastening can be achieved, for example, by injection molding the body 7 made of plastic and inserting the reinforcing element 5 into the mold during the injection molding process. As an alternative, it is also possible to produce the body 7 made of plastic and the reinforcing element 5 separately and then to attach them to the reinforcing element 5 by clipping, clamping, adhesive bonding or screwing, for example. However, it is preferred if the connection between the reinforcing element 5 and the body 7 made of plastic is achieved by through-injection during the process for producing the body 7 made of plastic.

Figure 2:
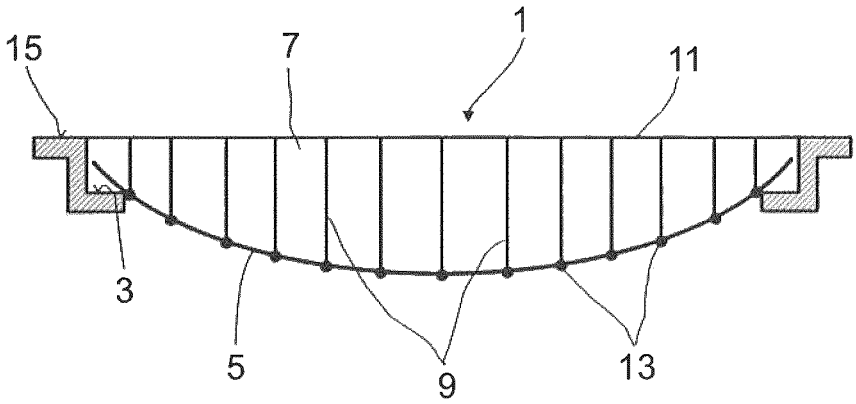
FIG. 2 shows a manhole cover having a downward-arched reinforcing element.

FIG. 2 shows a manhole cover having a downward-arched reinforcing element. The manhole cover 1 shown in FIG. 2 differs from that shown in FIG. 1 in the direction in which the reinforcing element 5 is arched. In contrast to the embodiment shown in FIG. 1, the reinforcing element 5 is arched downward in the embodiment shown in FIG. 2. This makes it possible to use the manhole cover 1 for manholes, sewer accesses or drainage channels in which the distance between the bearing surface 3 and the surface 15, e.g. a road surface, is less than that in the embodiment shown in FIG. 1, for example. Apart from the direction of curvature of the reinforcing element 5, the construction of the embodiments shown in FIGS. 1 and 2 corresponds.

Both in the embodiment shown in FIG. 1 and in the embodiment shown in FIG. 2, it is possible to provide the plate 11 shown here, which rests on top, in order to obtain a smooth surface. As an alternative, however, it is also possible to dispense with the plate 11 which rests on top, with the result that the body 7 made of plastic is constructed only of ribs 9. It is furthermore also possible to provide a base plate, wherein said base plate is shaped in such a way, for example, that it rests on the reinforcing element 5 or extends centrally in the body 7 made of plastic, with the result that the ribs 9 extend upward and downward from the base plate. Here, the base plate can be provided either in an embodiment with a plate 11 which rests on top or one without a plate 11 which rests on top.

The reinforcing element 5 can be a full-surface plate, for example.

An alternative embodiment for a reinforcing element is shown in FIG. 3.

In the embodiment shown in FIG. 3, the reinforcing element 5 comprises an encircling strip 17 and a central plate 19. The encircling strip 17 and the central plate 19 are connected to one another by curved strips 21. The curved strips 21 result in arching of the reinforcing element 5. Here, the alignment to produce the manhole cover can be as in FIGS. 1 and 2, i.e. it is arched upward or arched downward.

FIG. 4 shows two individual parts from which the reinforcing element shown in FIG. 3 can be constructed.

In this case, the reinforcing element 5 is constructed from two individual parts, where the first part 23 has the encircling strip 17 and strips 25 extending toward the center of the reinforcing element. The second part 27 has the central plate 19 and outward-extending strips 29. To produce the first part 23 and the second part 27, it is possible, for example, to punch the second part 27 out of a round plate. Given appropriate configuration of the outward-extending strips 29, the first part 23 having the encircling strip 17 and the strips 25 extending toward the center is left as a remainder after the punching process. For this purpose, the strips 25, 29 are preferably configured in such a way that the width of the strip 25 extending toward the center on the first part 23 corresponds, at the inner circumference of the encircling strip 17, to the outer width of the outward-extending strips 29 of the second part 27. In corresponding fashion, the width of the strips 25 of the first part 27, which extend toward the center, correspond at their ends to the width of the outward-extending strips 29 of the second part 27 at the circumference of the central plate 19. After the production of the first part 23 and of the second part 27, these parts are formed in order to form the arching. For this purpose, a pressing method, e.g. a deep drawing method, can be used, for example. After the forming process, the strips 29 of the second part and the strips 25 of the first part are connected to one another. In order to obtain a stable connection, the strips 25, 29 are welded to one another, for example. For a stable connection, it is particularly preferred here if the second part 27 is inserted into the first part 23 for the connection of the strips 25, 29. Apart from welding, however, any other method for connecting the two parts 23, 27 is also possible, e.g. screwing, riveting or adhesive bonding. It is also possible to connect the two parts 23, 27 by overmolding with the plastic compound for the body 7 made of plastic.

An embodiment of a reinforcing element having an outer encircling strip and a rod, wherein the rod and the encircling strip are connected to one another by spokes, is shown in FIG. 5.

The reinforcing element shown in FIG. 5 comprises an encircling strip 17 and a rod 31. A plate 33 can additionally be mounted on the rod 31, wherein a force acts on the plate 33 when subjected to load. In order to transmit the force acting on the plate 33 to the encircling strip 17 as well, the rod 31 on which the plate 33 rests is attached to the encircling strip 17 by spokes 35. As an alternative to the spokes 35, it is also possible to use cables or strips made of the same material as the encircling strip 17 and the rod 31, by means of which the rod 31 is attached to the encircling strip 17. Particularly steel or any material which is well-suited to bearing tensile stress is suitable as a material for cables.

As an alternative to the embodiment with a rod and an upper plate, it is also possible to configure the reinforcing element as shown in FIG. 6 with an encircling strip 17 and a central plate 19, wherein the central plate 19, unlike the embodiment shown in FIGS. 3 and 4, is attached to the encircling strip 17 not by means of wide strips but by means of spokes 35. Here too, it is possible, as an alternative to the spokes 35, to attach the central plate 17 to the encircling strip 17 by means of cables.

Another possible embodiment for an reinforcing element 5 is shown in FIG. 7. In the embodiment shown in FIG. 7, the reinforcing element 5 has a corrugated outer circumference 37. Here, the corrugations extend to the central point 39 of the reinforcing element 5, with the result that the corrugations become smaller toward the center.

Instead of the corrugated configuration shown in FIG. 7, it is also possible to introduce any desired corrugations into the reinforcing element 5. A particularly preferred option here is a corrugation shape which corresponds substantially to the corrugated shape shown in FIG. 7, namely corrugations which are wider at the outer circumference and the width of which decreases toward the center. Here, the corrugations do not necessarily have to extend as far as the central point 39 but can end at a distance from the central point 39.

FIG. 8 shows a detail of a manhole cover having an arched reinforcing element and, additionally, a second plate made of the same material as the reinforcing element, wherein the body made of plastic is formed between the reinforcing element and the additional plate.

In the embodiment shown in FIG. 8, the manhole cover 1 has a reinforcing element 5 which is arched downward. Here, the reinforcing element can be embodied in the manner shown in FIG. 2, for example. In addition to the reinforcing element 5, the manhole cover 1 of the embodiment shown in FIG. 8 has an upper plate 41. Here, the body 7 made of plastic is positioned between the reinforcing element 5 and the upper plate 41. In the embodiment shown here, the body made of plastic has vertically extending ribs 9 and a base plate 43. Here, the ribs 9 extend upward and downward from the base plate 43. In this case, the body 7 made of plastic rests by means of the ribs 9 on the reinforcing element 5, and the upper plate 41 rests on the ribs 9 extending upward from the base plate 43.

In order to obtain a smooth surface, an outer envelope 45 made of plastic is provided in the embodiment shown in FIG. 8. In this case, the outer envelope 45 made of plastic surrounds the reinforcing element 5, the upper plate 41 and the body 7 made of plastic. In this case, the same plastic can be used as a material for the body 7 made of plastic and the outer envelope 45. However, it is also possible to use different polymers.

Two further alternative embodiments of a manhole cover having an reinforcing element 5, an upper plate 41 and a body 7 made of plastic, which is positioned between the reinforcing element 5 and the upper plate 41, are shown in FIGS. 9 and 10.

In contrast to the embodiment shown in FIG. 8, the embodiments shown in FIGS. 9 and 10 do not have an outer envelope 45 made of plastic. However, it is also possible to embody the embodiments shown in FIGS. 9 and 10 with an outer envelope 45 as well. It is also possible to dispense with the outer envelope 45 in the embodiment shown in FIG. 8.

In the embodiment shown in FIG. 8, the reinforcing element 5 and the upper plate 41 are connected to one another at the rim by a flange connection. In this case, the connection can be made positively, materially or nonpositively, although a nonpositive connection, e.g. by screwing or riveting, is preferred. If an outer envelope 45 made of plastic is provided, it is also possible to dispense with the additional connection between the reinforcing element 5 and the upper plate 41 since they are positioned and held relative to one another by the outer envelope 45.

In the embodiments shown in FIGS. 9 and 10, an elastomer connection 47 is provided to connect the reinforcing element 5 and the upper plate 41. In the embodiment shown in FIG. 9, the elastomer connection 47 surrounds the upper plate 41 along the outer circumference thereof and is positioned in a horizontal plane between an upward-extending rim 49 of the reinforcing element 5 and the upper plate 41. In contrast, the elastomer connection 47 in the embodiment shown in FIG. 10 is positioned on the outer rim of the reinforcing element 5, and the upper plate 41 rests on the elastomer connection 47.

The use of an elastomer connection 47 has the advantage that differential thermal expansions of the individual component elements can thereby be compensated.

As an alternative to the embodiment shown in FIG. 10 having an elastomer connection 47, it is also possible to provide a positive connection or a nonpositive connection.

In FIGS. 11.1 to 11.4, different variants for the arrangement of ribs in the body 7 made of plastic are shown. Here, the body 7 made of plastic has a circular cross section in the embodiments shown in FIGS. 11.1 to 11.3 and a square cross section in the embodiment shown in FIG. 11.4. In this case, the shape of the body 7 made of plastic usually corresponds to the shape of the manhole cover 1. In the case of a round manhole cover 1, the body 7 made of plastic is also round and, in the case of an angular manhole cover 1, the body 7 made of plastic is likewise angular.

In the embodiments shown in FIGS. 11.1 to 11.4, the ribs form a rectangular division, wherein a square division, as shown, is preferred here. In this case, the individual ribs 9 of the body 7 made of plastic intersect at an angle of 90°. As an alternative to the square division shown here, however, it is also possible to provide a triangular division or any other division, for example, wherein the ribs 9 intersect at an angle different from 90° in this case.

In the embodiment shown in FIG. 11.2, the ribs 9 extend radially from the central point of the body 7 made of plastic to the outer rim. In this case, it would also be possible to arrange for the ribs to extend outward from an eccentrically situated point, but it is preferred if the ribs extend radially from the central point 39 of the body 7 made of plastic to the outer rim.

In addition, it is possible to provide ribs 9 which surround the central point 39 of the body 7 made of plastic in a ring shape. This is shown by way of example in FIG. 11.3. In this case, the ribs surrounding the central point 39 in a ring shape intersect the ribs 9 extending radially outward from the central point 39.

Of course, it is also possible to use the variants of a body 7 made of plastic which are shown in FIGS. 11.2 and 11.3 with any other cross-sectional area, e.g. a rectangular or square cross-sectional area.

In addition to the profiles, shown here, of the ribs 9, any other alignment of the ribs 9 which is known to a person skilled in the art is also possible.

An alternative embodiment of a manhole cover 1 is shown in FIG. 12.

In contrast to the above-described reinforcing elements 5, the reinforcing element 5 in the embodiment shown in FIG. 12 is constructed from vertically extending elements. Here, the reinforcing element 5 in the embodiment shown in FIG. 12 has two intersecting elements 51. In this case, the elements 51 are at an angle of 90° to one another. The body 7 made of plastic rests on the reinforcing element 5 formed by the elements 51. This body has ribs 9 and a plate 11 resting on top. By means of the ribs 9, the body 7 made of plastic rests on the vertical elements 51 of the reinforcing element 5.

In addition to the embodiment shown in FIG. 12, having two intersecting elements 51, it is also possible to provide a plurality of elements 51. In this case, these elements can extend radially outward from the central point or, alternatively, can extend parallel to one another, for example. It is preferred here if at least one element 51 is aligned transversely to the elements 51 extending in parallel, with the result that the elements 51 aligned in parallel intersect the element 51 extending transversely thereto. In addition to just one element 51 extending transversely to the elements 51 aligned in parallel, it is, of course, also possible to provide a plurality of elements 51 extending in parallel in both directions, giving a rectangular division, for example. As an alternative, however, any other alignment of the vertically extending elements 51 for the formation of the reinforcing element 5 is also conceivable. Thus, these can extend in the manner of the variants of the ribs 9 of the body 7 made of plastic which are illustrated in FIGS. 11.2 and 11.3, for example.

LIST OF REFERENCE SIGNS

1 manhole cover
3 bearing surface
5 reinforcing element
7 body made of plastic
9 rib
11 plate resting on top
13 enlarged portion
15 surface
17 encircling strip
19 central plate
21 strip
23 first part
25 strip extending toward the center
27 second part
29 outward-extending strip
31 rod
33 plate
35 spoke
37 outer circumference
39 central point
41 upper plate
43 base plate
45 outer envelope
47 elastomer connection
49 upward-extending rim
51 element

The invention claimed is:

1. A manhole cover for manholes, sewer accesses or drainage channels, comprising an reinforcing element and a body made of plastic, which is connected to the reinforcing element, wherein the reinforcing element is designed in such a way that said reinforcing element rests on a bearing surface on the manhole, sewer access or drainage channel when the manhole, sewer access or drainage channel is closed by means of the manhole cover, and the body made of plastic comprises ribs made of plastic, which extend perpendicularly or at an angle of more than 45° to the surface surrounding the manhole, sewer access or drainage channel when the manhole, sewer access or drainage channel is closed, wherein the reinforcing element is manufactured from a metal, and wherein additionally one of the following features is included:

the reinforcing element is arched, corrugations are formed in the reinforcing element, the reinforcing element has a corrugated outer circumference, wherein the corrugations extend to a central point of the reinforcing element, the corrugations thereby become smaller toward the center.

2. The manhole cover as claimed in claim 1, wherein the reinforcing element is constructed from arched strips which converge in the center of the reinforcing element.

3. The manhole cover as claimed in claim 1, wherein openings are formed in the reinforcing element.

4. The manhole cover as claimed in claim 1, wherein the plastic of the body which is connected to the reinforcing element is selected from thermoplastic or thermosetting polyesters, polyamide, polyvinylchloride, polypropylene, polyethylene, polystyrene, polycarbonate, styrene-acrylonitrile copolymer, acrylonitrile-butadiene-styrene copolymer, acrylonitrile-styrene-acrylic ester, polyoxymethylene, polymethylmethacrylate, syndiotactic polystyrene, polyphthalimide, polyphenylene sulfide, formaldehyde resins, unsaturated polyester resins, vinyl ester resins, phenacrylate resins, vinyl ester urethanes, epoxy resins, diallyl phthalate resins, allyl esters, silicone resins and polyurethanes.

5. The manhole cover as claimed in claim 1, wherein the body made of plastic has a flat plate, which rests on the ribs and is connected materially to the ribs.

6. The manhole cover as claimed in claim 1, wherein holes are formed in the reinforcing element, through which holes the plastic of the body made from plastic is forced for connection to the reinforcing element, or wherein the body made of plastic is clipped or screwed to the reinforcing element.

7. The manhole cover as claimed in claim 1, wherein the body made of plastic rests slidably on the reinforcing element.

8. The manhole cover as claimed in claim 1, wherein the body made of plastic surrounds the reinforcing element at the outer circumference.

9. The manhole cover as claimed in claim 1, wherein countersunk holes are formed in the manhole cover, through which holes the manhole cover can be screwed to the bearing surface on the manhole, sewer access or drainage channel.

* * * * *